US007841890B2

(12) United States Patent
Chen et al.

(10) Patent No.: US 7,841,890 B2
(45) Date of Patent: Nov. 30, 2010

(54) CABLE ASSEMBLY WITH JUMPER FUNCTION

(75) Inventors: Yong-Jun Chen, Shenzhen (CN); Xian-Kui Shi, Shenzhen (CN); Chung-Yen Yang, Tu-Cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/482,480

(22) Filed: Jun. 11, 2009

(65) Prior Publication Data

US 2009/0311906 A1 Dec. 17, 2009

(30) Foreign Application Priority Data

Jun. 11, 2008 (CN) ..... 2008 2 0301119 U

(51) Int. Cl.
*H01R 11/20* (2006.01)

(52) U.S. Cl. ..... 439/404; 439/510

(58) Field of Classification Search ..... 439/499, 439/411, 467, 578, 404, 494, 510
See application file for complete search history.

(56) References Cited

U.S. PATENT DOCUMENTS 5,194,010 A * 3/1993 Dambach et al. ..... 439/79
5,358,424 A * 10/1994 Bowen et al. ..... 439/405
7,618,282 B2 * 11/2009 Wu et al. ..... 439/496
2002/0045382 A1 * 4/2002 Takahashi ..... 439/499
2008/0076295 A1 * 3/2008 Lappoehn ..... 439/499

FOREIGN PATENT DOCUMENTS

TW 409978 12/2000

* cited by examiner

*Primary Examiner*—Neil Abrams
*Assistant Examiner*—Phuong Nguyen
(74) *Attorney, Agent, or Firm*—Wei Te Chung; Andrew C. Cheng; Ming Chieh Chang

(57) ABSTRACT

A cable assembly, comprises a housing with a plurality of terminal receiving passages extending from a front surface to a rear surface thereof and arranged into an upper row and a lower row. A plurality of insulation displacement terminals are received into the corresponding terminal receiving passages; each insulation displacement terminal defines a connecting portion beyond the rear surface of the housing. A flat cable is defined by a plurality of conductors arranged side by side in a transverse direction and an insulative layer surrounding the conductors, and is pressed to the rear surface of the housing and insulation displacement connected with the insulation displacement terminals, each conductor of the flat cable electrically connects with two insulation displacement terminals in a vertical direction. And a cover is assembled to the housing and hold the flat cable to the housing.

15 Claims, 5 Drawing Sheets

CABLE ASSEMBLY WITH JUMPER FUNCTION

FIELD OF THE INVENTION

The present invention relates to cable assembly, particularly to a cable assembly having a simplified structure and easily to be assembled, and with a jumper function thereof.

DESCRIPTION OF PRIOR ART

Currently, an elongate housing of a cable assembly usually defines a plurality of terminal passageways therein extending in a longitudinal direction. The terminal passageways are arranged into an upper row and a lower row in a vertical direction. Each terminal passageway of the upper row is in alignment with a corresponding terminal passageway of the lower row in a vertical direction. A plurality of terminals are received into the corresponding terminal passageways of the elongate housing. An electrically connecting between two terminals needs to an additional conductive wire which is soldered with two connecting portions of the above said two terminals. However, several pairs of terminals in a vertical direction all need a manual welding to achieve an electrically connecting between each pair of terminals. So, this assembling method between the terminals and cables of the cable assembly is troubled and waste a lot of assembling time.

TW Pat. No. 409978 issued on Oct. 21, 2000 discloses a flat cable connector assembly. The flat cable connector assembly comprises an insulative housing 4, a plurality of insulation displacement terminals 6 arranged into an upper row and a lower row and received into the insulative housing 4, a flat cable 7 with a plurality of conductors 70 insulation displacement contacted with the corresponding insulation displacement terminals 6 and a cover 5 covered to a rear face of the insulative housing 2 and positioned the flat cable 7 between the insulative housing 2 and the cover 5. Each insulation displacement terminal 6 electrically connects with a conductor 70 of the flat cable 7 through insulation displacement connection. However, each terminal 6 of the upper row is misalignment with the terminal 6 of the lower row. Thus, each conductor 70 of the flat cable 7 is only electrically connected with only a terminal 6. So the cable assembly does not a have a jumper function as the terminals 6 arrangement form in the insulative housing 4.

As discussed above, an improved cable assembly overcoming the shortages of existing technology is needed.

SUMMARY OF THE INVENTION

Accordingly, an object of the present invention is to provide a cable assembly having a simple structure and easily to be assembled, and with a jumper function thereof.

In order to achieve the above-mentioned objects, a cable assembly, comprises a housing with a plurality of terminal receiving passages extending from a front surface to a rear surface thereof and arranged into an upper row and a lower row. A plurality of insulation displacement terminals are received into the corresponding terminal receiving passages; each insulation displacement terminal defines an engaging portion, a mating portion extending forwardly from the engaging portion and a connecting portion extending rearwardly from the engaging portion and beyond the rear surface of the housing. A flat cable is defined by a plurality of conductors arranged side by side in a transverse direction and an insulative layer surrounding the conductors, and is pressed to the rear surface of the housing and insulation displacement connected with the insulation displacement terminals, each conductor of the flat cable electrically connects with two insulation displacement terminals in a vertical direction. And a cover is assembled to the housing and hold the flat cable to the housing.

Other objects, features and advantages of the invention will be apparent from the following detailed description taken in connection with the accompanying drawings.

DETAILED DESCRIPTION OF PREFERRED EMBODIMENTS

Figure 1:
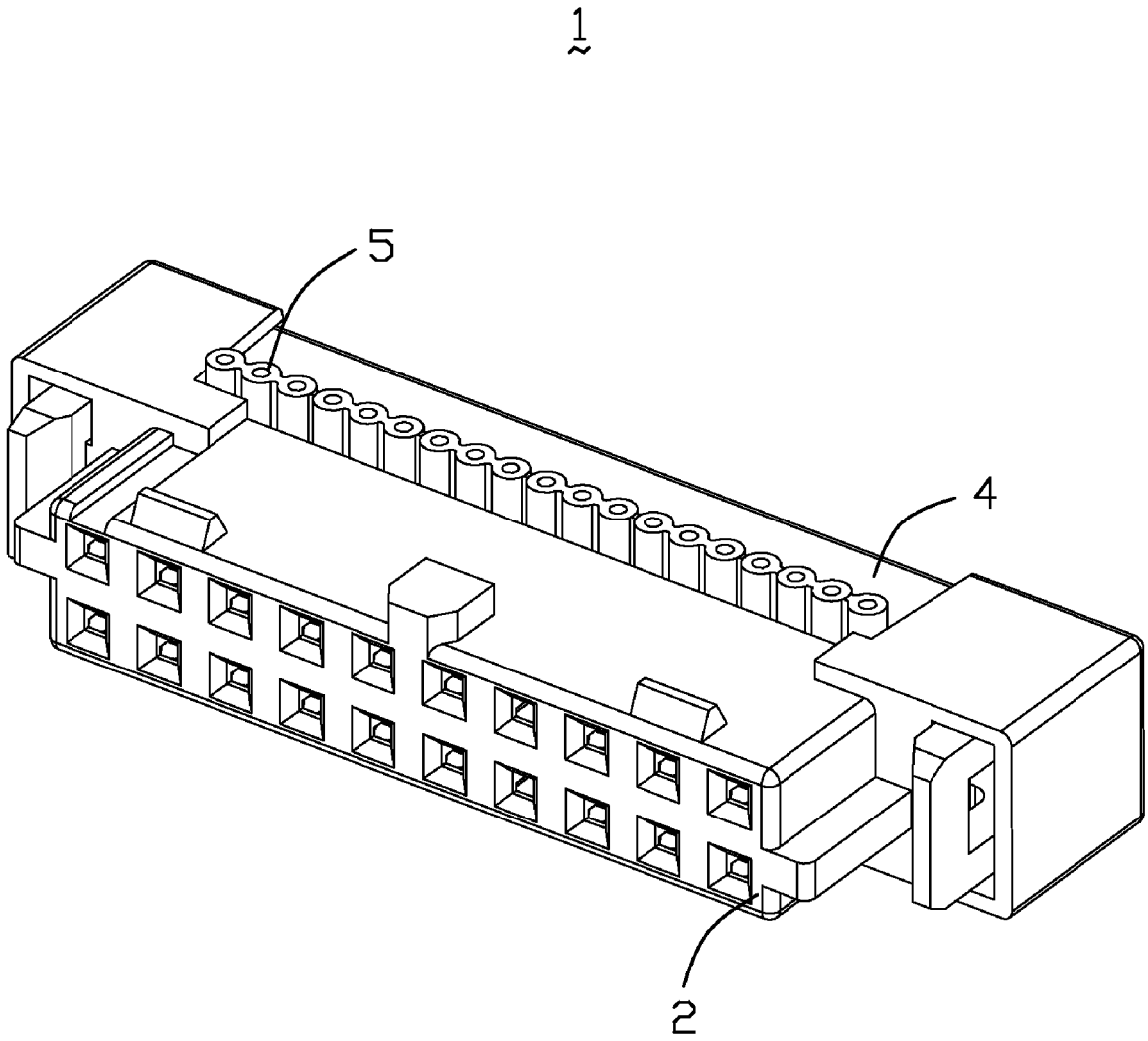
FIG. 1 is a perspective view of a cable assembly in accordance with the present invention.

Reference will now be made to the drawing figures to describe the present invention in detail.

Figure 2:
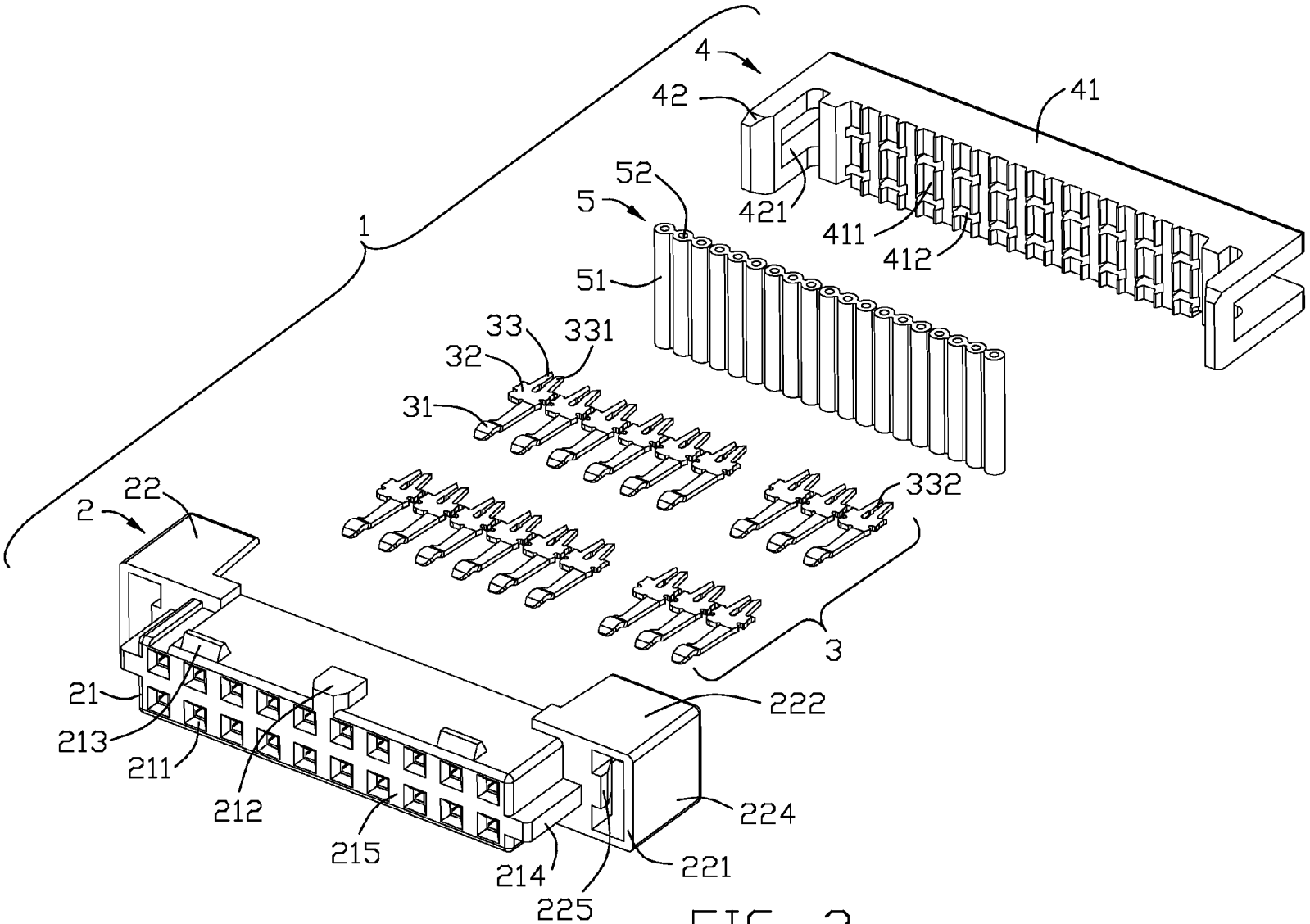
FIG. 2 is an exploded, perspective view of the cable assembly of FIG. 1.

Referring to FIGS. 1 and 2, a cable assembly in accordance with the present invention, generally designated 1, is adapted for mating with a complementary connector (not shown). The cable assembly 1 comprises an insulative housing 2, a plurality of insulation displacement terminals 3 received into the insulative housing 2, a cover 4 assembled to a rear portion of the insulative housing 2 and a flat cable 5 electrically connected with the terminals 3 and disposed between the insulative housing 2 and the cover 4.

Figure 3:
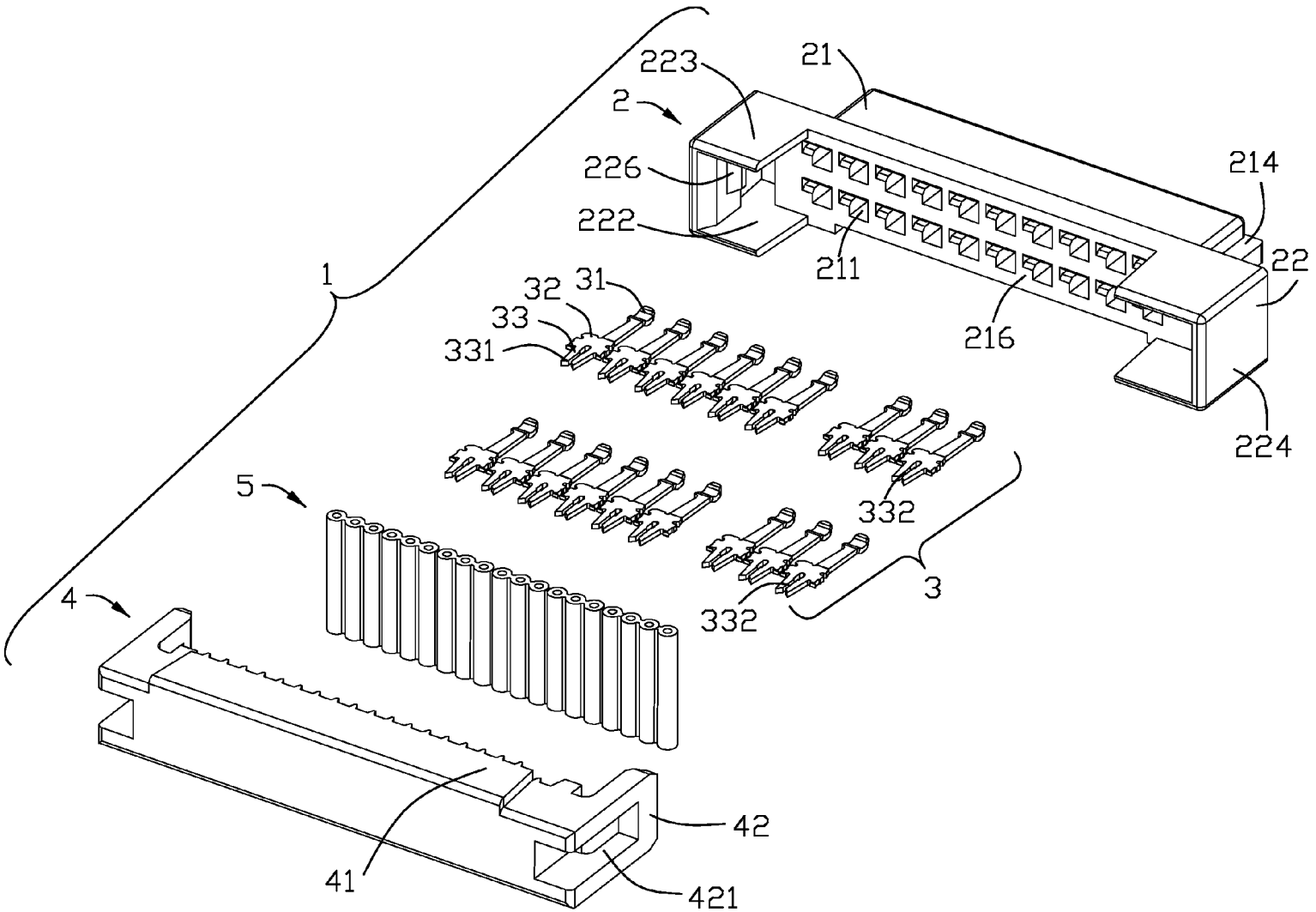
FIG. 3 is similar to FIG. 2, but viewed from another aspect.

Referring to FIGS. 2 and 3, the insulative housing 2 defines an elongate mating portion 21 and a pair of wing portions 22 extending rearwardly and outwardly from outside surface of the mating portion 21.

The mating portion 21 of the insulative housing 2 has a front surface 215 and a rear surface 216 opposite to the front surface 215. The mating portion 21 of the insulative housing 2 defines a plurality of terminal receiving passages 211 therein extending rearwardly from the front surface 215 to the rear surface 216 of the mating portion 21. A plurality of terminal receiving passages 211 are arranged into a pair of upper and lower rows. Each receiving passage 211 of the upper row is in alignment with a corresponding receiving passage 211 of the lower row in a vertical direction. Each receiving passage 211 has a front opening and a rear opening respectively formed in a front surface 215 and a rear surface 216 of the mating portion 21 of the housing 2. The front opening is square and the rear opening is L-shaped. A trapezoidal guiding member 212 is formed on a top surface of the mating portion 21 of the housing 2 and for guiding the cable assembly 1 to the complementary connector. A pair of wedge-shaped engaging members 213 are also formed on the top surface of the mating portion 21 of the housing 2 and disposed at two sides of the trapezoidal guider member 212 and for locking with the complementary connector. Each engaging members 213 has an inclined front face and an inclined rear face opposite to the inclined front face. So, the cable assembly 1 is conveniently attached or deattached to the complementary connector. A pair of guiding posts 214 are respectively formed on two opposite side surfaces of the mating portion 21 of the insulative housing 2.

Each wing portion 22 has a front wall 221 extending laterally from a side surface of the mating portion 21 of the housing 2, a pair of upper and lower walls 222, 223 extending rearwardly from a top and a bottom side of the front wall 221 and respectively extending to the top and bottom surface of the mating portion of the housing 2 and a side wall 224 connected with the upper wall 222 and the lower wall 223. A channel is formed by the above said walls 221, 222, 223, 224. A rectangular hole is formed in the front wall 221. A wedge-shaped block 225 is formed on an inner face of the rectangular hole. A wedge-shaped block 226 is also formed on an inner face of the side wall 224.

Figure 4:
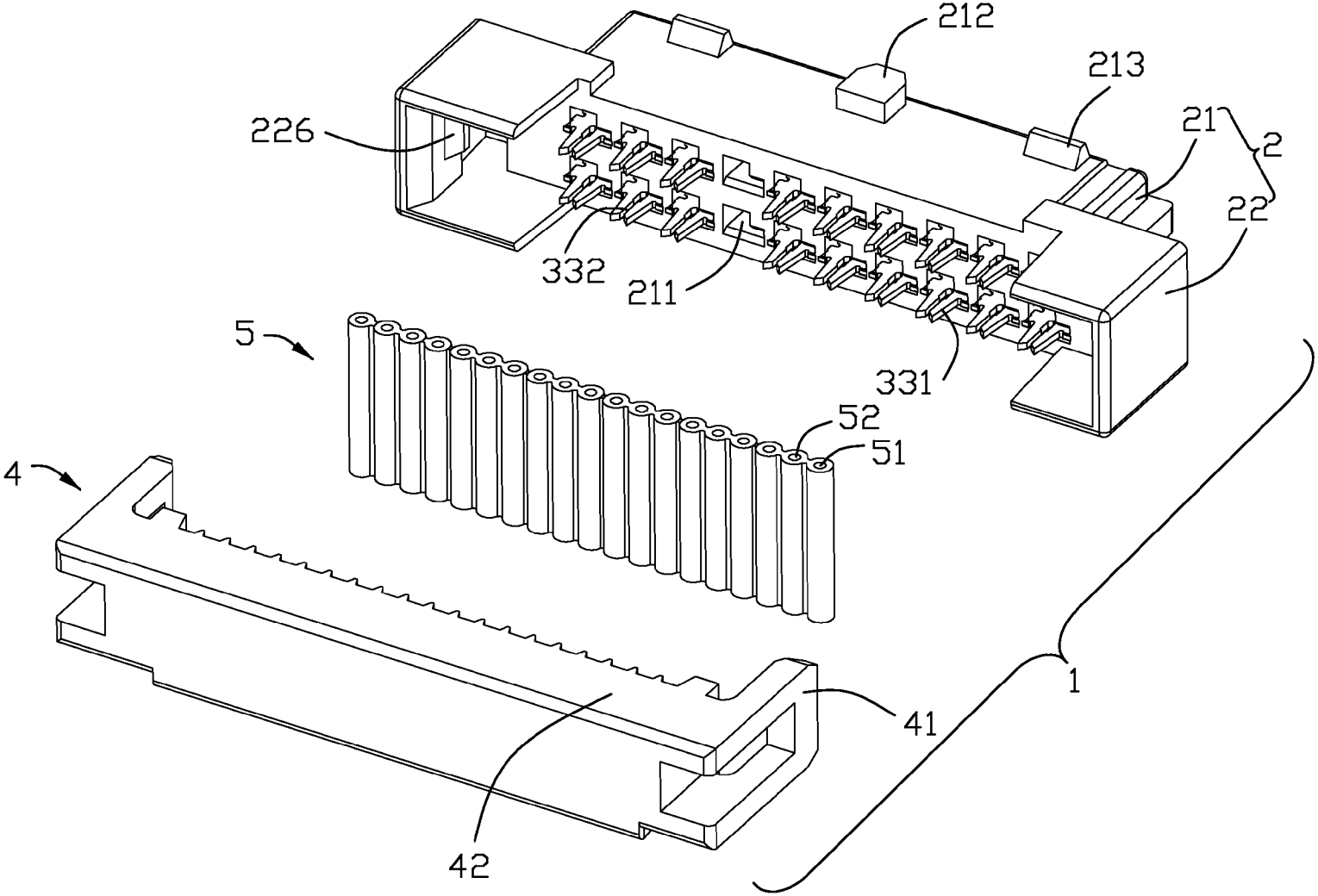
FIG. 4 is a partial assembled, perspective view of the cable assembly of FIG. 3.

Referring to FIG. 2 to 4, a plurality of insulation displacement terminals 3 are arranged to two rows and respectively received into the corresponding terminal receiving passages 211. Each insulation displacement terminal 3 defines an engaging portion 32, a mating portion 31 extending forwardly from the engaging portion 32 and a connecting portion 32 extending rearwardly from the engaging portion 32. The connecting portion 32 defines a pair of insulation displacement blades 331 defining a slot 332 for receiving a conductor 52 of the flat cable 5.

Figure 5:
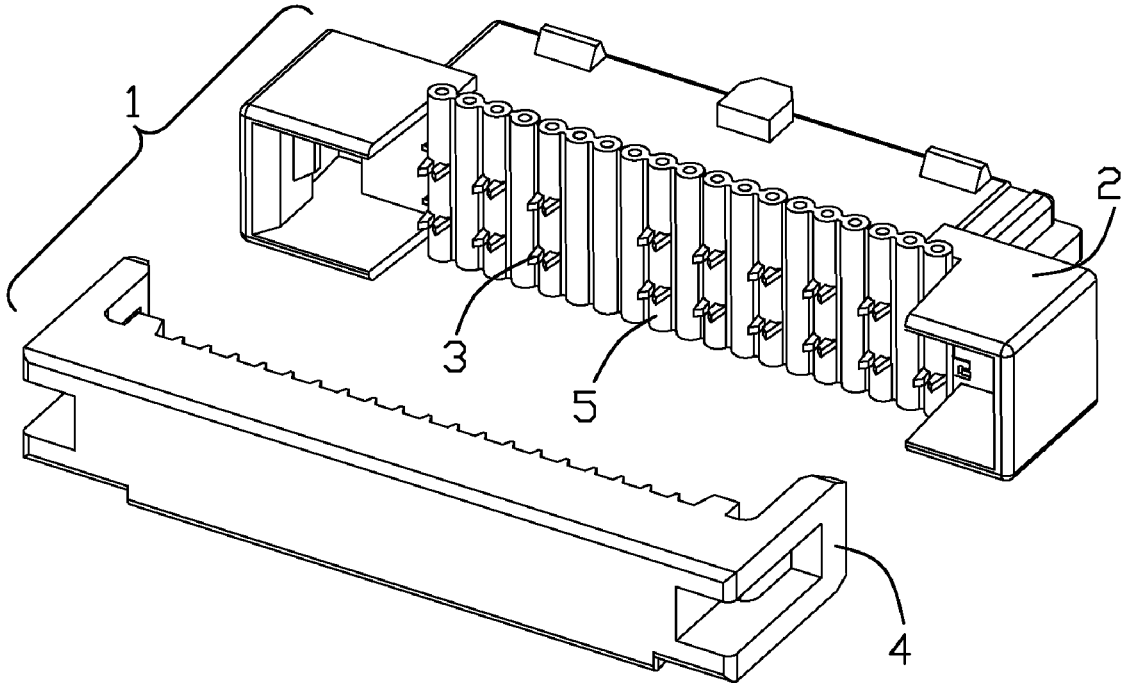
FIG. 5 is a partial assembled, perspective view of the cable assembly of FIG. 4.

Referring to FIGS. 2 and 5, a flat cable 5 defines a plurality of conductors 52 arranged side by side in a transverse direction and an insulative layer 52 surrounding the conductors 52. Two adjacent conductors 52 are separated by the insulative layer 52.

Referring to FIGS. 2, the cover 4 has a base portion 41 and a pair of latching portion 42 extending forwardly from two sides of the base portion 41. The base portion 41 has a plurality of positioning slots 411 formed on a front surface thereof and arranged side by side in a transverse direction. Each positioning slot 411 extends from a top surface to a bottom surface of the base portion 41 in a up-to-down direction. Each positioning slot 411 has two recesses 412 arranged in vertical direction. Each latching portion 42 defines a hole 421 therein for receiving two wedge-shaped blocks 225, 226.

Referring to FIGS. 1 to 5, the assembling process of the cable assembly 1 in according to the present invention starts from assembling the insulation displacement terminals 3 into the insulative housing 2. The mating section 31 of the insulation displacement terminal 3 is received into a front end of the terminal receiving passage 211, the engaging portion 32 is engaged with a rear end of the terminal receiving passage 211 and the connecting portion 23 extends out of the rear surface 216 of the mating portion 21 of the insulative housing 2.

After the terminals 3 are assembled to the insulative housing 2, then assembling the flat cable 5 to the rear surface 216 of the mating portion 51 of the insulative housing 2 and electrically connected with the terminals 3. Insulative layer 51 surrounding a conductor 52 of the flat cable 2 is press-fitted into the slot 322, the insulative layer 51 of the flat cable 5 is pierced through by the inner sides of the pair of insulation displacement blades 331, and a pair of inner sides of the pair of insulation displacement blades 331 come in press-contact with the conductor 52 of the flat cable 5. When a front surface of the flat cable 5 attaches to the rear surface 216 of the mating portion 21 of the insulative housing 2, two rear ends of the pair of insulation displacement blades 331 are located beyond a rear surface of the flat cable 5.

At last, assembling the cover 4 to the insulative housing 2. The front surface of the base portion 41 of the cover 4 attaches to the rear surface of the flat cable 5. A rear half portion of the flat cable 5 is received into the a plurality of positioning slots 411 arranged side by side in a transverse direction. So, the flat cable 5 is received into a receiving space formed between the insulative housing 2 and the cover 4. Two rear ends of the pair of insulation displacement blades 33 1 are received into a recess 412. At this time, each latching portion 42 is received into the channel of the wing portion 22, and the wedge-shaped blocks 225, 226 are received into the hole 421 of the latching portion 42. So, the cover 4 is interlocked with the insulative housing 2.

Through the above assembling steps, the cable assembly 1 is accomplished. As the flat cable 5 electrically connects with the insulation displacement terminal 3 through insulation displacement connection, so the cable assembly 1 is easily and quickly assembled. In addition, one conductor 52 of the flat cable 5 of the cable assembly 1 is electrically connected with two insulation displacement terminals 3 in a vertical direction to achieve a jumper function. So, the cable assembly 1 overcomes the shortages of existing technology.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A cable assembly, comprising:

a housing with a plurality of terminal receiving passages extending from a front surface to a rear surface thereof and arranged into an upper row and a lower row;

a plurality of insulation displacement terminals received into the corresponding terminal receiving passages, each insulation displacement terminal defining an engaging portion, a mating portion extending forwardly from the engaging portion and a connecting portion extending rearwardly from the engaging portion and beyond the rear surface of the housing;

a flat cable defined by a plurality of conductors arranged side by side in a transverse direction and an insulative layer surrounding the conductors, and being pressed to the rear surface of the housing and insulation displacement connected with the insulation displacement terminals, each conductor of the flat cable electrically connecting with two insulation displacement terminals in a vertical direction; and the mating portion of the insulation displacement terminal is received into a front end of the terminal receiving passage, the engaging portion is engaged with a rear end of the terminal receiving passage and the connecting portion extends out of the rear surface of the mating portion of the insulative housing; the front opening is square and the rear opening is L-shaped; a trapezoidal guiding member is formed on a top surface of the mating portion of the housing for guiding the cable assembly to the complementary connector;

a pair of wedge-shaped engaging members are also formed on the top surface of the mating portion of the housing and disposed at two sides of the trapezoidal guider member and for locking with the complementary connector; each engaging members has an inclined front face and an inclined rear face opposite to the inclined front face for the cable assembly being conveniently attached or de-attached to the complementary connector;

a pair of guiding posts are respectively formed on two opposite side surfaces of the mating portion of the insulative housing;

a cover assembled to the housing and hold the flat cable to the housing;

the cover defines a base portion and a pair of latching portions extending forwardly from two sides of the base portion, the base portion has a plurality of positioning slots formed on a front surface thereeof and arranged side by side in a transverse direction; each positioning slot extends from a top surface to a bottom surface of the base portion in a up-to-down direction; each positioning slot has two recesses arranged in vertical direction; each latching portion defines a hole therein for receiving two wedge-shaped blocks.

2. The cable assembly as recited in claim 1, wherein, a plurality of insulation displacement terminals are arranged to two rows and respectively received into the corresponding terminal receiving passages.

3. The cable assembly as recited in claim 2, wherein, a flat cable defines a plurality of conductors arranged side by side in a transverse direction and an insulative layer surrounding the conductors.

4. The cable assembly as recited in claim 1, wherein the housing defines a mating portion and a pair of wing portions extending rearwardly and outwardly from the mating portion, a receiving space is formed between the pair of the wing portions and the rear surface of the housing.

5. The cable assembly as recited in claim 4, wherein a portion of the flat cable and the base portion of latching portion are disposed in the receiving space.

6. The cable assembly as recited in claim 5, wherein, two adjacent conductors are separated by the insulative layer.

7. The cable assembly as recited in claim 1, wherein, each receiving passages has a front opening and a rear opening respectively formed in a front surface of the mating portion of the housing.

8. The cable assembly as recited in claim 7, wherein the connecting portion defines a pair of insulation displacement blades defining a slot therebetween.

9. The cable assembly as recited in claim 8, wherein the insulative layer surrounding each conductor of the flat cable is press-fitted into the slot, the insulative layer of the flat cable is pierced through by the inner sides of the pair of insulation displacement blades, and a pair of inner sides of the pair of insulation displacement blades come in press-contact with the conductor of the flat cable.

10. The cable assembly as recited in claim 9, wherein a pair of rear ends of the pair of insulation displacement blades pass through the flat cable and are received into a recess formed on a positioning slot of the cover.

11. A cable assembly, comprising:

an insulative housing defining an upper and a lower row of terminal receiving passages therein extending from a front surface to a rear surface thereof;

an upper row and a lower row of terminals disposed in the corresponding terminal receiving passages with a plurality of connecting portions thereof beyond the rear surface of the insulative housing;

a flat cable formed by a plurality of conductors therein and an insulative layer surrounding the conductors, the flat cable being pressed to the rear surface of the insulative housing and insulation displacement connected with the connecting portions of the terminals, each conductor connecting with two connecting portions of an upper terminal and a lower terminal;

the mating portion of the insulation displacement terminal is received into a front end of the terminal receiving passage, the engaging portion is engaged with a rear end of the terminal receiving passage and the connecting portion extends out of the rear surface of the mating portion of the insulative housing; the front opening is square and the rear opening is L-shaped;

a trapezoidal guiding member is formed on a top surface of the mating portion of the housing for guiding the cable assembly to the complementary connector;

a pair of wedge-shaped engaging members are also formed on the top surface of the mating portion of the housing and disposed at two sides of the trapezoidal guider member and for locking with the complementary connector; each engaging members has an inclined front face and an inclined rear face opposite to the inclined front face for the cable assembly being conveniently attached or de-attached to the complementary connector;

a pair of guiding posts are respectively formed on two opposite side surfaces of the mating portion of the insulative housing;

a cover engaged to the insulative housing and making the flat cable disposed between the cover and the insulative housing;

the cover defines a base portion and a pair of latching portions extending forwardly from two sides of the base portion, the base portion has a plurality of positioning slots formed on a front surface thereeof and arranged side by side in a transverse direction; each positioning slot extends from a top surface to a bottom surface of the base portion in a up-to-down direction; each positioning slot has two recesses arranged in vertical direction; each latching portion defines a hole therein for receiving two wedge-shaped blocks.

12. The cable assembly as recited in claim 11, wherein a rear end of each connecting portions of the terminal passes through the flat cable and received into a recess formed on a front surface of the cover.

13. The cable assembly as recited in claim 11, wherein the insualtive housing defines a mating portion and a pair of wing portions extending rearwardly and outwardly from the mating portion, a receiving space is formed between the pair of the wing portions and the rear surface of the housing.

14. The cable assembly as recited in claim 13, wherein the connecting portions of the terminals, a portion of the flat cable and a base portion of the cover are disposed in the receiving space.

15. The cable assembly as recited in claim 13, the cover has a pair of latching portions engaged with the pair of wing portions of the insulative housing.

* * * * *